US007374260B2

(12) United States Patent
Lu

(10) Patent No.: US 7,374,260 B2
(45) Date of Patent: May 20, 2008

(54) HIDDEN TYPE SLIDING RAIL ASSEMBLY AUTO LOCKING STRUCTURE FOR DRAWER

(75) Inventor: Chun-Min Lu, Taipei Hsien (TW)

(73) Assignee: Gslide Corporation, Taipei Hsien (TW)

( * ) Notice: Subject to any disclaimer, the term of this patent is extended or adjusted under 35 U.S.C. 154(b) by 137 days.

(21) Appl. No.: 11/477,395

(22) Filed: Jun. 30, 2006

(65) Prior Publication Data

US 2007/0278919 A1 Dec. 6, 2007

(30) Foreign Application Priority Data

Jun. 2, 2006 (TW) ..... 95209591 U

(51) Int. Cl.
*A47B 88/04* (2006.01)

(52) U.S. Cl. ..... 312/333; 312/319.1

(58) Field of Classification Search ..... 312/319.1, 312/333, 330.1, 334.1, 334.7, 334.8, 334.44, 312/334.46, 334.47; 384/21, 22
See application file for complete search history.

(56) References Cited

U.S. PATENT DOCUMENTS

| | | | | |
|---|---|---|---|---|
| 5,207,781 | A * | 5/1993 | Rock | 312/319.1 |
| 6,672,692 | B2 * | 1/2004 | Weng | 312/333 |
| 6,799,817 | B1 * | 10/2004 | Chu | 312/333 |
| 6,979,066 | B2 * | 12/2005 | Yang | 312/333 |
| 7,077,487 | B2 * | 7/2006 | Yang | 312/333 |
| 2002/0033658 | A1 * | 3/2002 | Salice | 312/334.14 |
| 2005/0093406 | A1 * | 5/2005 | Yang | 312/333 |

* cited by examiner

*Primary Examiner*—James O. Hansen
(74) *Attorney, Agent, or Firm*—Troxell Law Office, PLLC

(57) ABSTRACT

A hidden type sliding rail assembly auto locking structure for drawer is disclosed comprised of a holder base, a slide, a coil spring member, a hook, a steel spring strip, a locking block, and an actuating block. When the outer sliding rail is moved outwards with the drawer, the actuating block pushes the steel spring strip to force the hook against the slide and to further force the locking block into a side notch and stopped at a stop edge at the holder base to prevent disconnection of the locking block, for enabling the coil spring member to return the drawer to the close position. Except the coil spring member, the holder base holds the other parts on the inside and keeps them from sight without the use of a cover, thereby saving much installation labor and time.

4 Claims, 14 Drawing Sheets

HIDDEN TYPE SLIDING RAIL ASSEMBLY AUTO LOCKING STRUCTURE FOR DRAWER

BACKGROUND AND SUMMARY OF THE INVENTION

The present invention relates to a sliding rail assembly for drawer and more specifically, to a hidden type auto locking structure used in a sliding rail assembly for drawer, which has a small size that does not require much installation space and, which keeps the parts from sight without the use of a cover.

FIGS. 1 and 2 illustrate a sliding rail assembly auto locking structure used in a sliding rail assembly 9 for drawer. This sliding rail assembly auto locking structure comprises a holder base 91, a spring member 92, a slide 93, and a push block 941 at the inner sliding rail 94. Because the spring member 92 is mounted in a spring chamber 912 inside the holder base 91, the spring member 92 is forced to rub against the inside wall of the spring chamber 912 when it is alternatively compressed and stretched. Therefore, the spring member 92 wears quickly with use. Further, it is difficult to replace the spring member 92 when the spring member 92 is damaged. Further, the slide 93 has two guide rods 931 and 932 for guiding reciprocating motion of the slide 93 in a sliding groove 911 inside the holder base 91. The sliding groove 911 has a downwardly extending front retaining groove portion 9111 for receiving one guide rod 931. When the user arranges the drawer or touches the drawer accidentally, the guide rod 931 of the slide 93 may be forced out of the front retaining groove portion 9111 of the sliding groove 911, causing the slide 93 to be pulled backwards by the spring member 92. In this case, the auto locking structure fails to function normally, and the drawer cannot be pushed to the rear side. U.S. Pat. Nos. 5,207,781 and 5,302,016 and PCT WO 01/8279A2 have same drawbacks. Further, the spring member 93 has one end hooked on one guide rod 931 of the slide 93 and is kept in a oblique manner, i.e., the spring member 93 is not horizontally stretched and compressed, resulting in instability of the reciprocating motion of the slide 93 and short working life of the spring member 93. Further, because the slide 93 vibrates heavily when it is pulled directly by the spring member 92 during its return stroke. Therefore, it is desirable to provide a sliding rail assembly auto locking structure that eliminates the aforesaid drawbacks.

The present invention has been accomplished under the circumstances in view. According to one aspect of the present invention, the hidden type sliding rail assembly auto locking structure is comprised of a holder base, a slide, a coil spring member, a hook, a steel spring strip, a locking block, and an actuating block. When the outer sliding rail is moved outwards with the drawer, the actuating block is stopped against the steel spring strip to force the hook against the slide, and at the same time the locking block is inserted into a side notch of the holder base and stopped at a stop edge at one side of the side notch to prevent disconnection of the locking block from the stop edge upon a vibration of the drawer due to an accidental condition. When the outer sliding rail is moved backwards with the drawer, the actuating block is stopped against the hook to bias the hook and to further move the locking block away from the stop edge of the holder base for allowing the steel spring strip to be forced against the actuating block of the outer sliding rail to push the outer sliding rail and the drawer backwards to the close position, thereby achieving the auto locking effect.

According to another aspect of the present invention, the slide, the hook, the spring member and the locking block are mounted in the holder base. The whole assembly has a small size that does not require much installation space. Further, the holder base does not need a cover to keep the inside parts from sight, thereby saving much installation labor and time.

According to still another aspect of the present invention, the hook does not bias outwards when the drawer is forced accidentally by an external force, and the user can directly push the drawer backwards to force the actuating block over the oblique steel spring strip to the position between the steel spring strip and the hook, and therefore the drawer is accurately returned to the close position.

According to still another aspect of the present invention, the spring member is provided outside the holder base. When the spring member is stretched or compressed, the spring member does not rub against the outside wall of the holder base. Therefore, the spring member is durable in use and replacement of the spring member can easily be performed.

According to still another aspect of the present invention, the hook is pivoted to the slide, and the slide is connected to the spring member. This arrangement assures smooth reciprocation of the slide in the holder base. Further, a hydraulic cylinder is used to buffer the return stroke of the slide, eliminating noise.

DETAILED DESCRIPTION OF THE INVENTION

Figure 1:
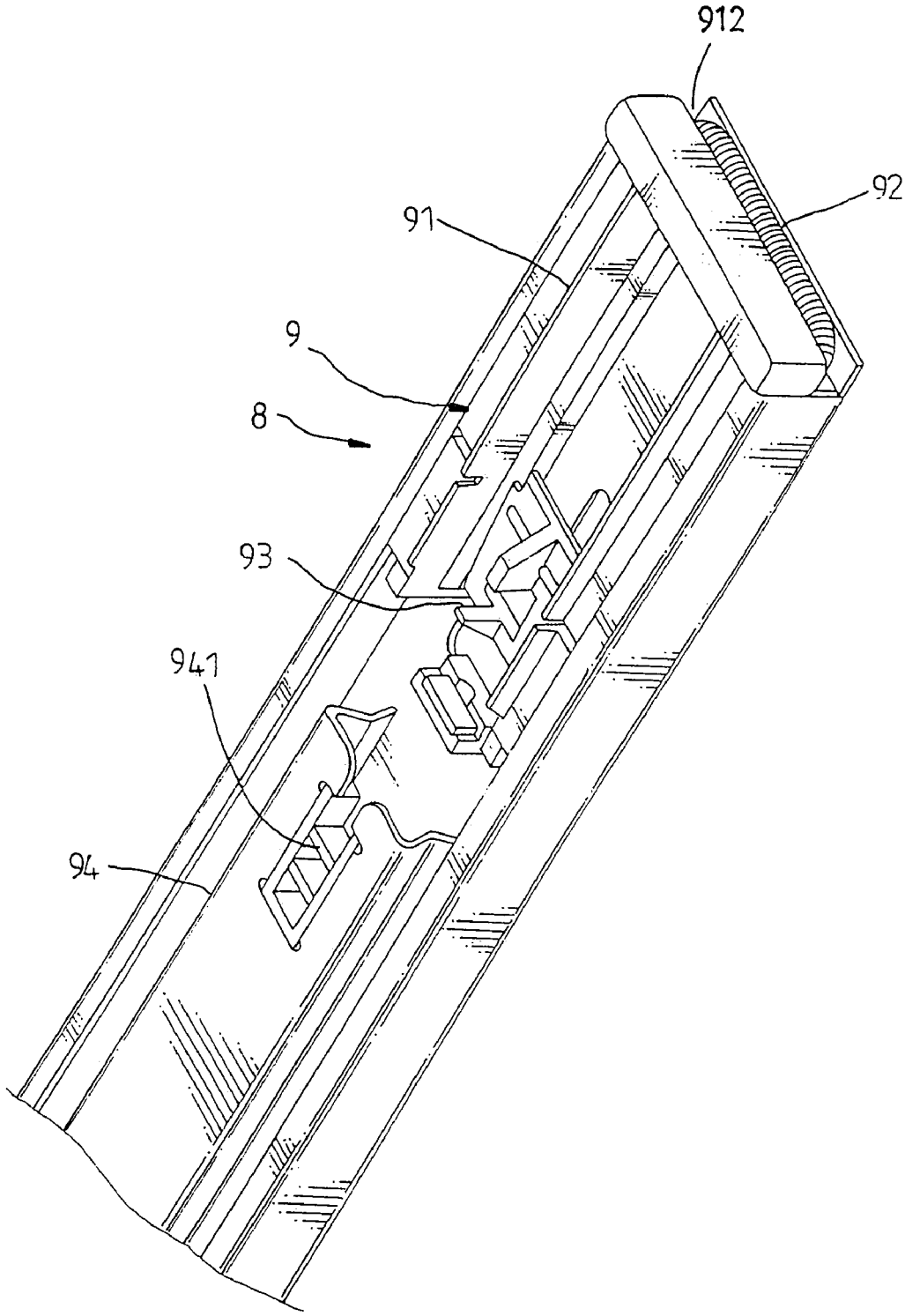
Fig. 1 PRIOR ART
FIG. 1 is a perspective view of a part of a sliding rail assembly auto locking structure according to the prior art.
Figure 2:
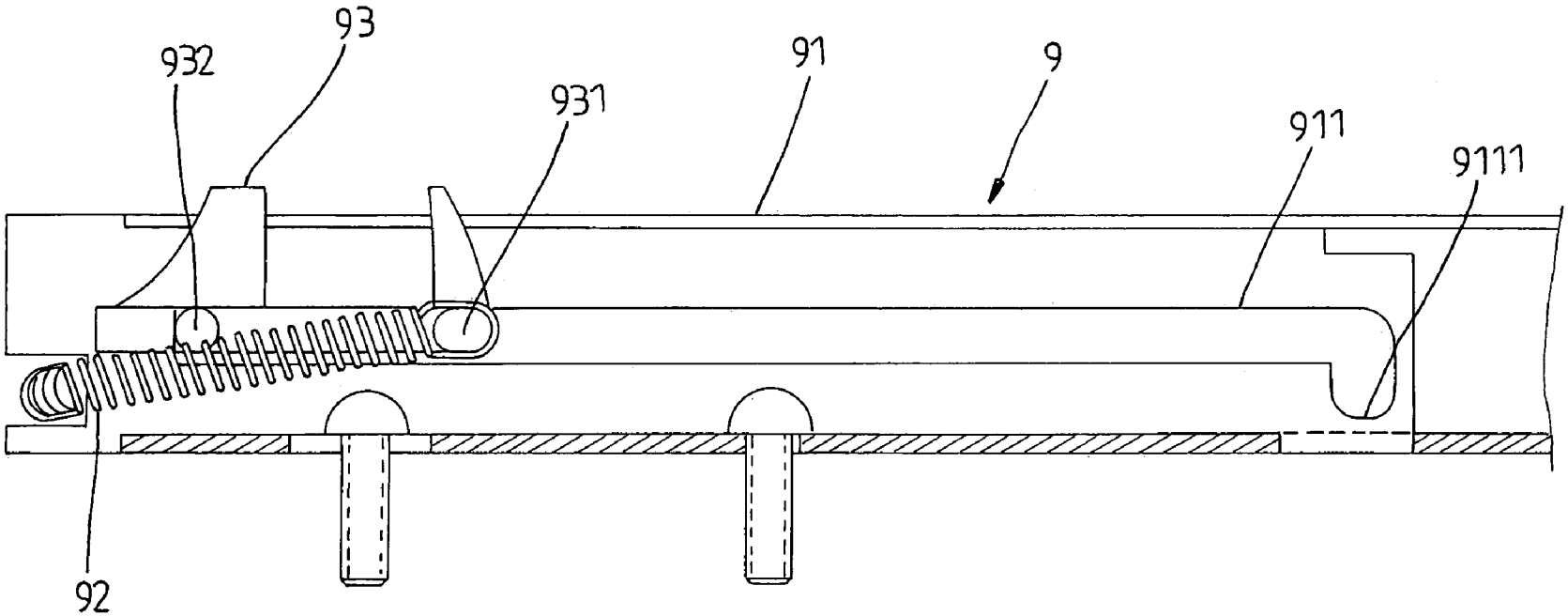
Fig. 2 PRIOR ART
FIG. 2 is a schematic side view of the sliding rail assembly auto locking structure according to the prior art.
Figure 3:
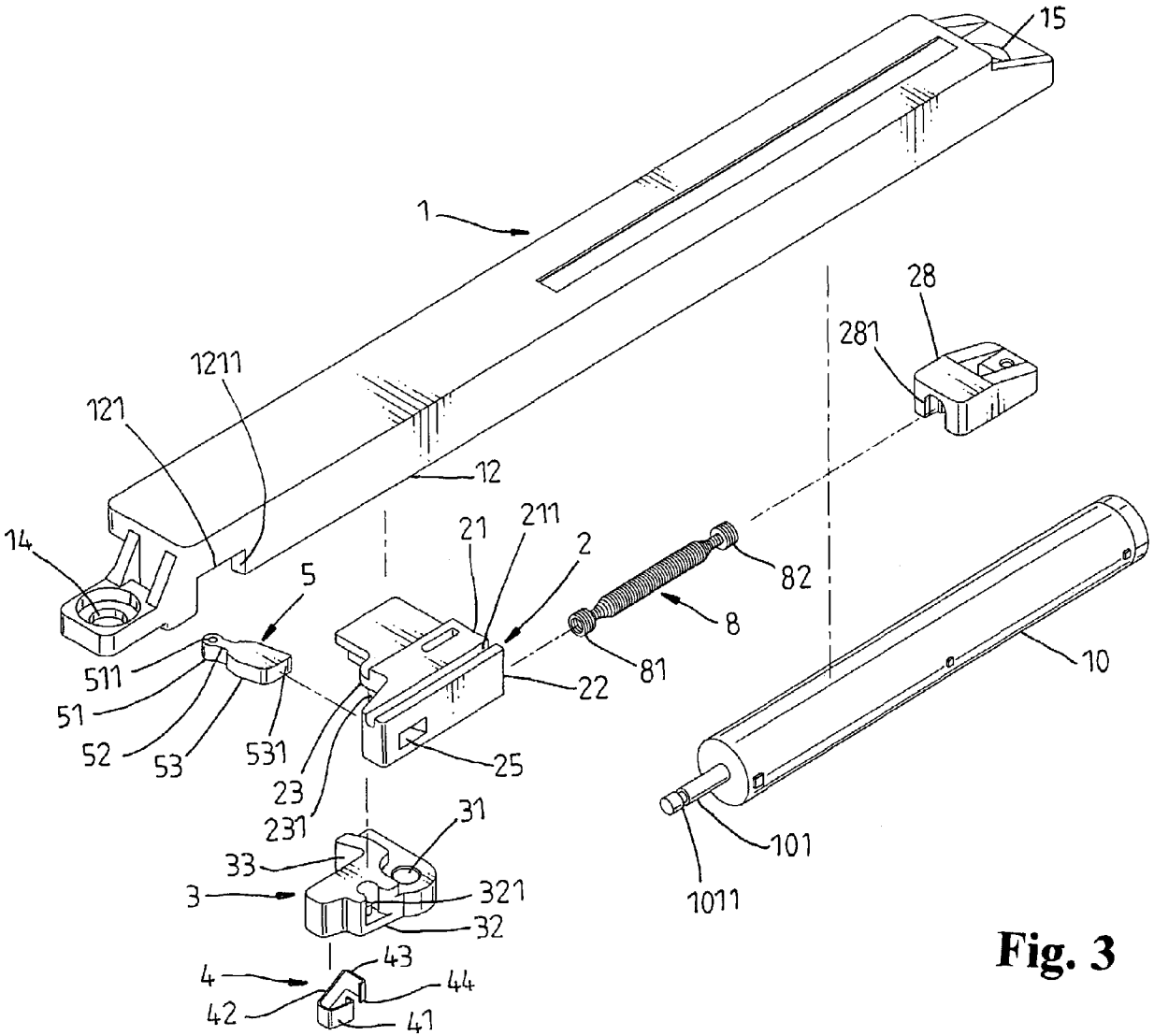
FIG. 3 is an exploded view of a hidden type sliding rail assembly auto locking structure according to the present invention.
Figure 4:
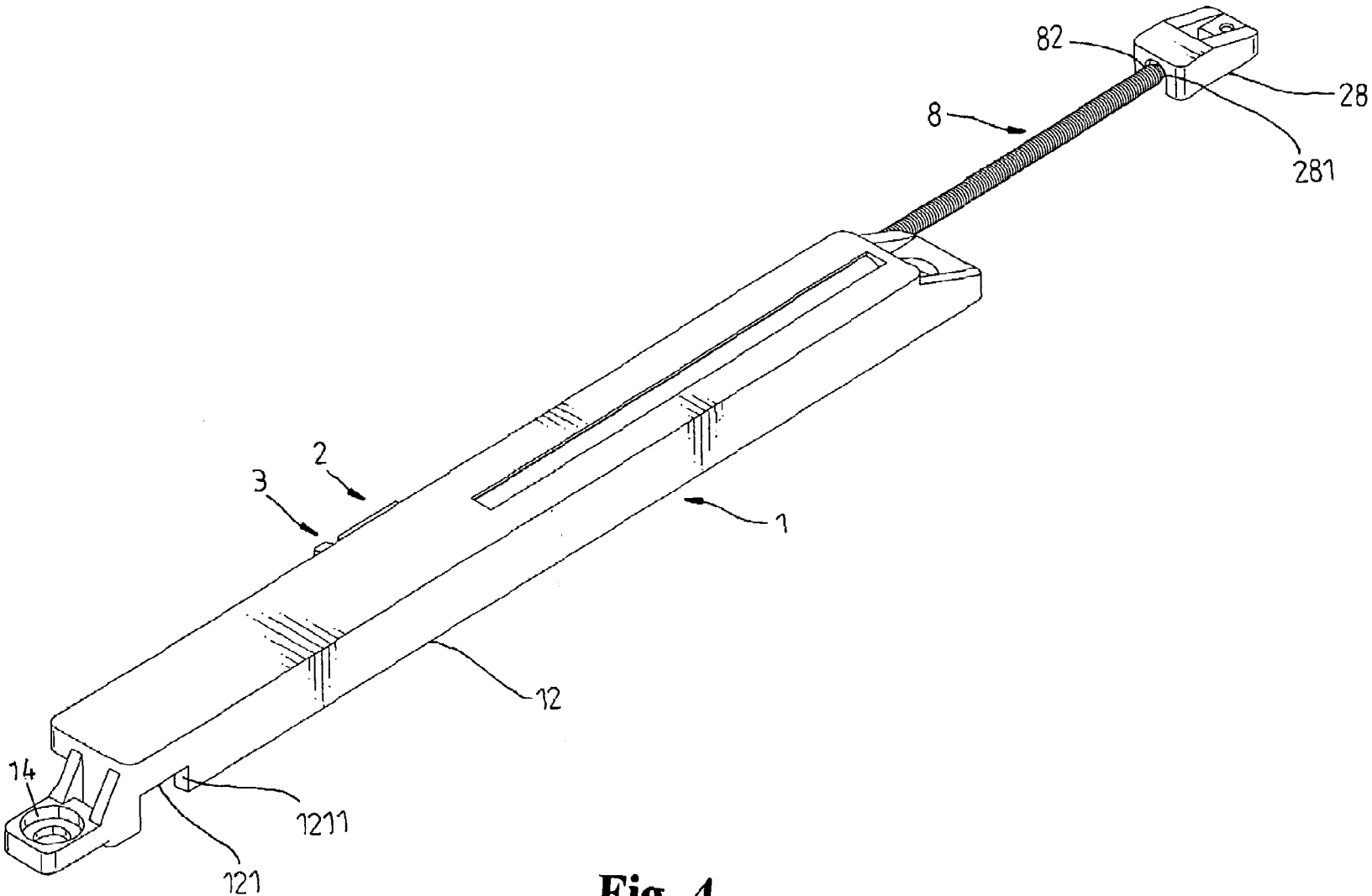
FIG. 4 is an oblique top assembly view of the hidden type sliding rail assembly auto locking structure according to the present invention.
Figure 5:
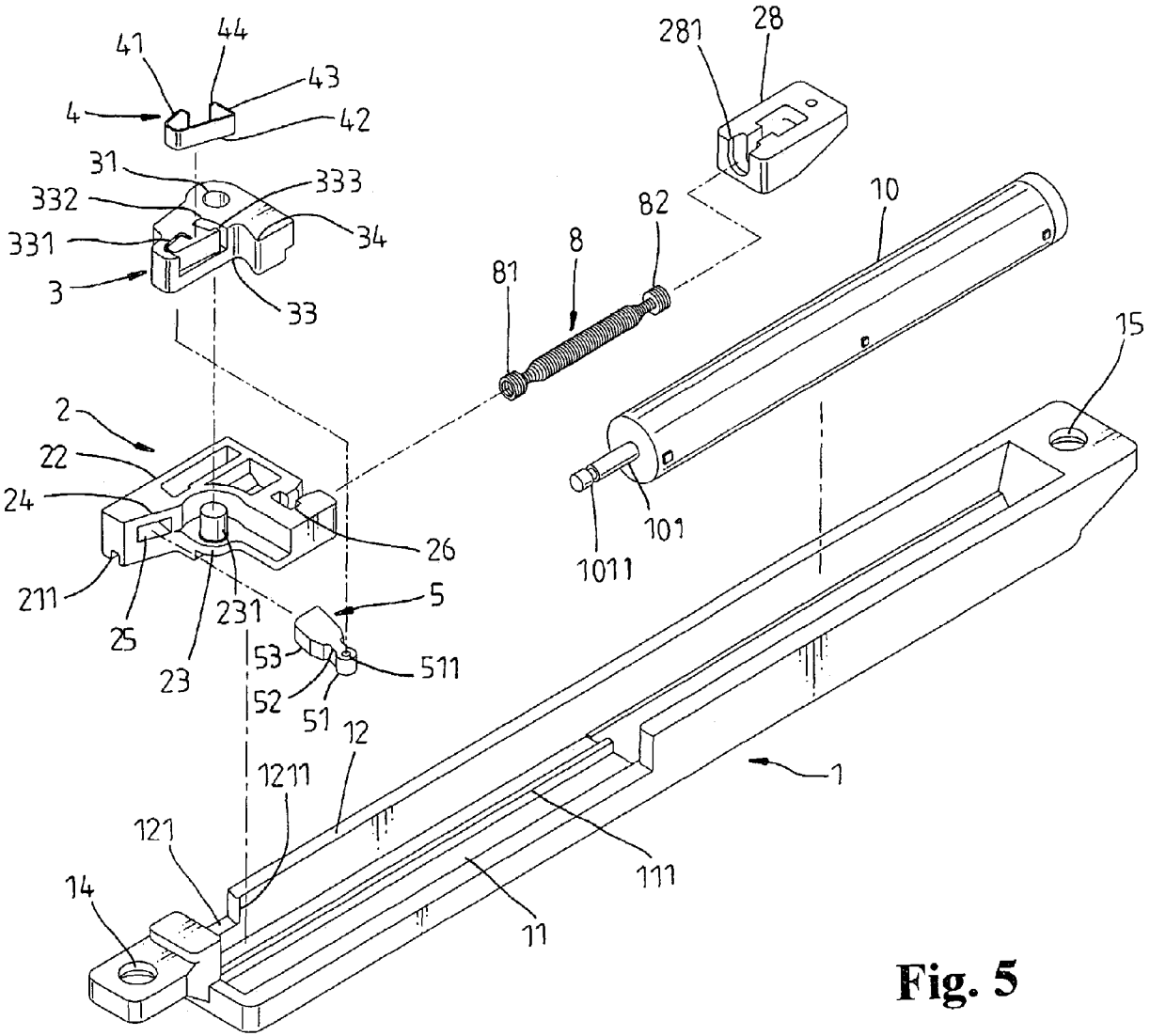
FIG. 5 corresponds to FIG. 3 when viewed from another angle.
Figure 6:
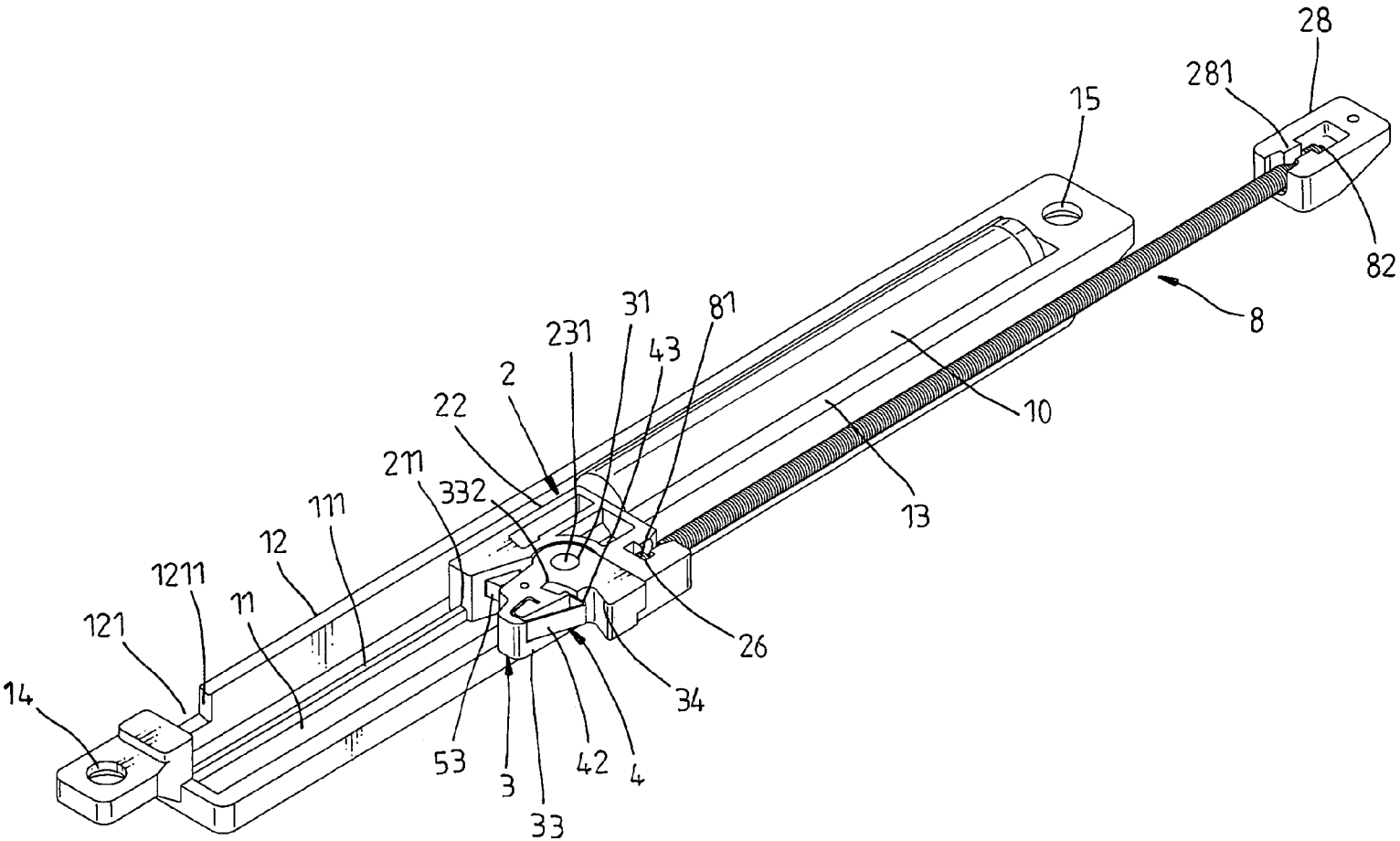
FIG. 6 is an oblique bottom assembly view of the hidden type sliding rail assembly auto locking structure according to the present invention.
Figure 7:
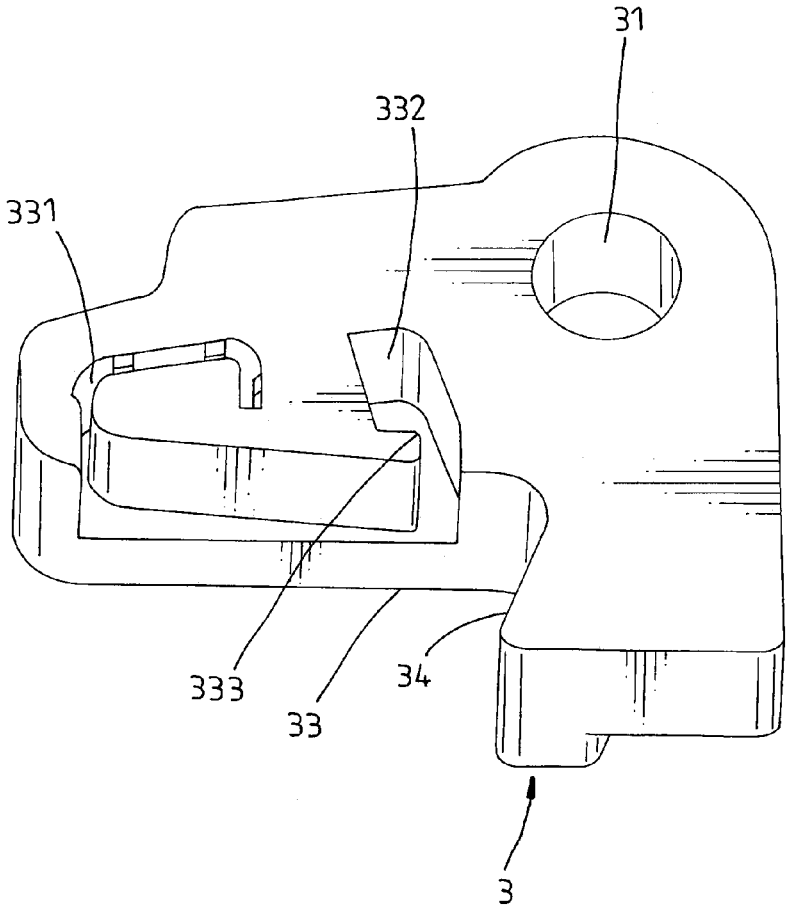
FIG. 7 is an enlarged view of a part of the hidden type sliding rail assembly auto locking structure according to the present invention.
Figure 8:
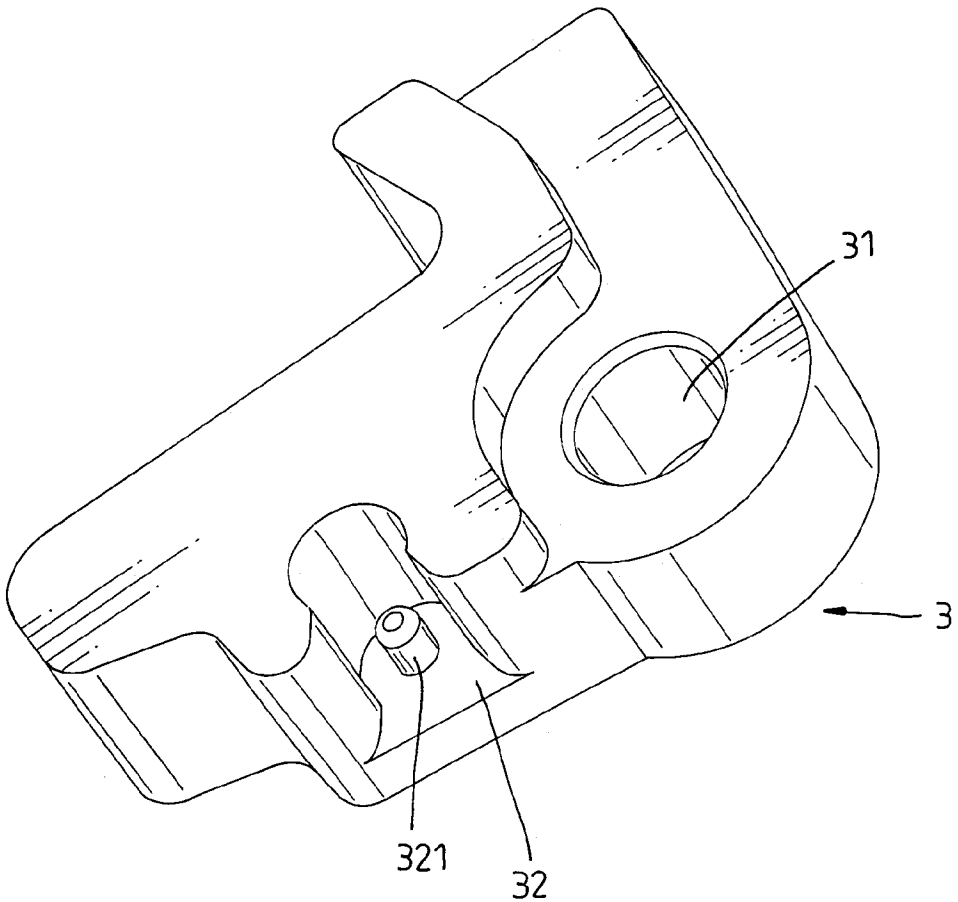
FIG. 8 corresponds to FIG. 7 when viewed from another angle.
Figure 9:
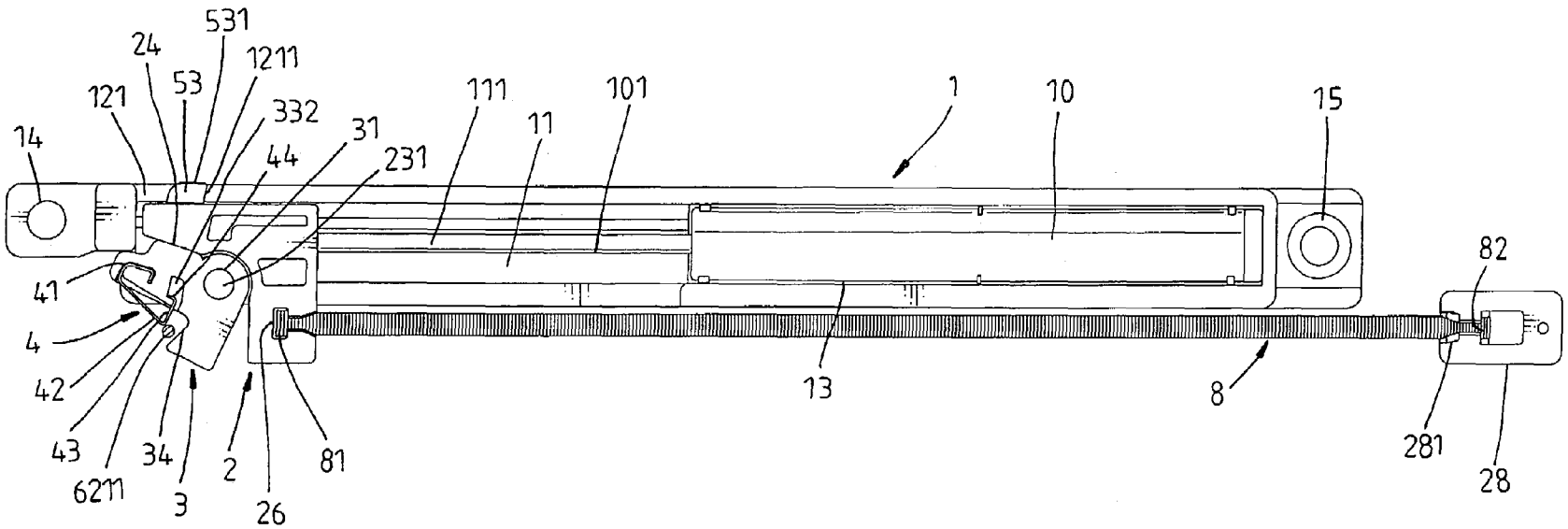
FIG. 9 is a side view of the present invention, showing the locking block stopped at the stop edge of the holder base.
Figure 10:
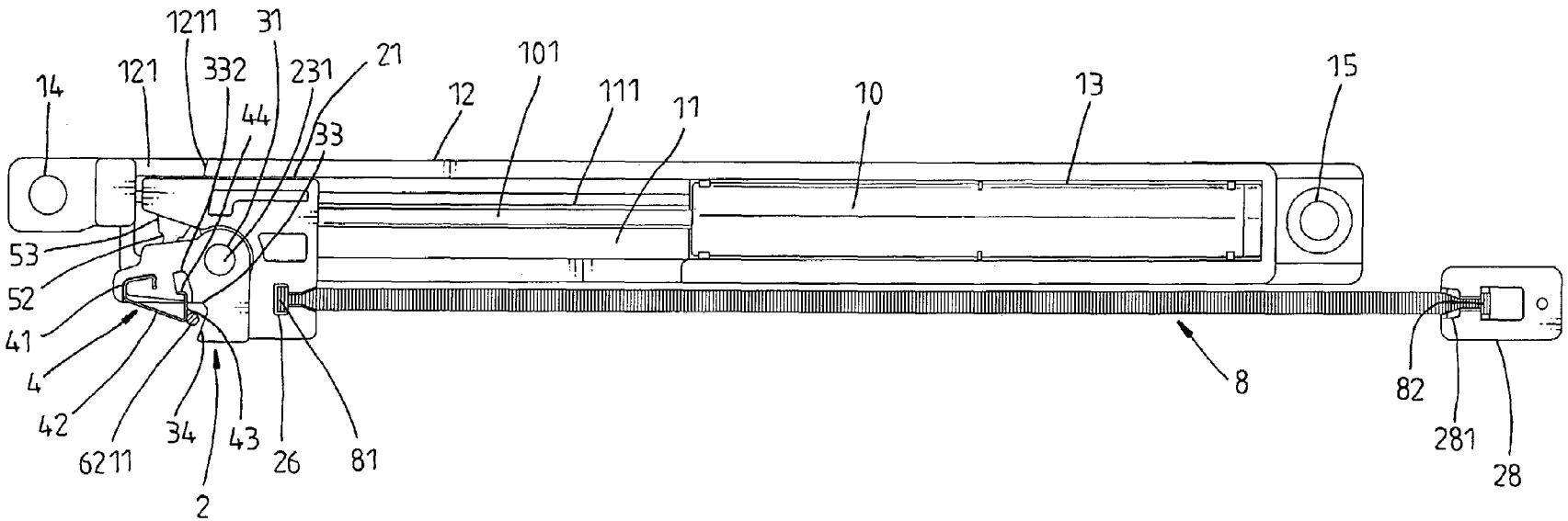
FIG. 10 corresponds to FIG. 9 but showing the locking block moved away from the stop edge of the holder base.
Figure 11:
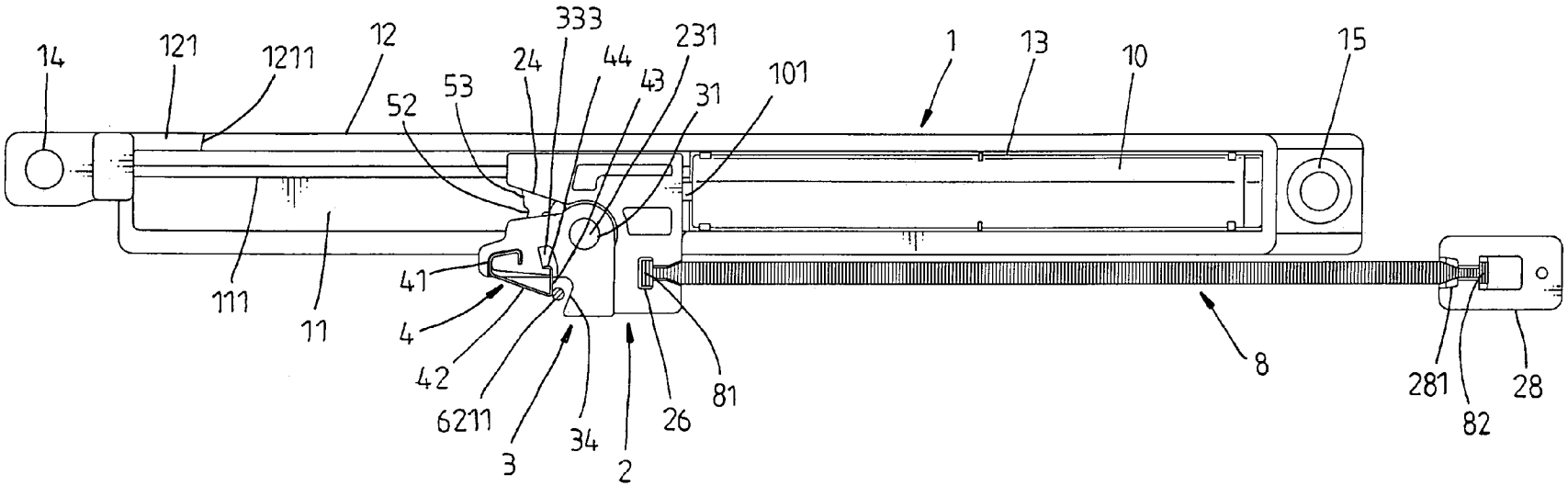
FIG. 11 corresponds to FIG. 10, showing backward movement of the slide and the hook.
Figure 12:
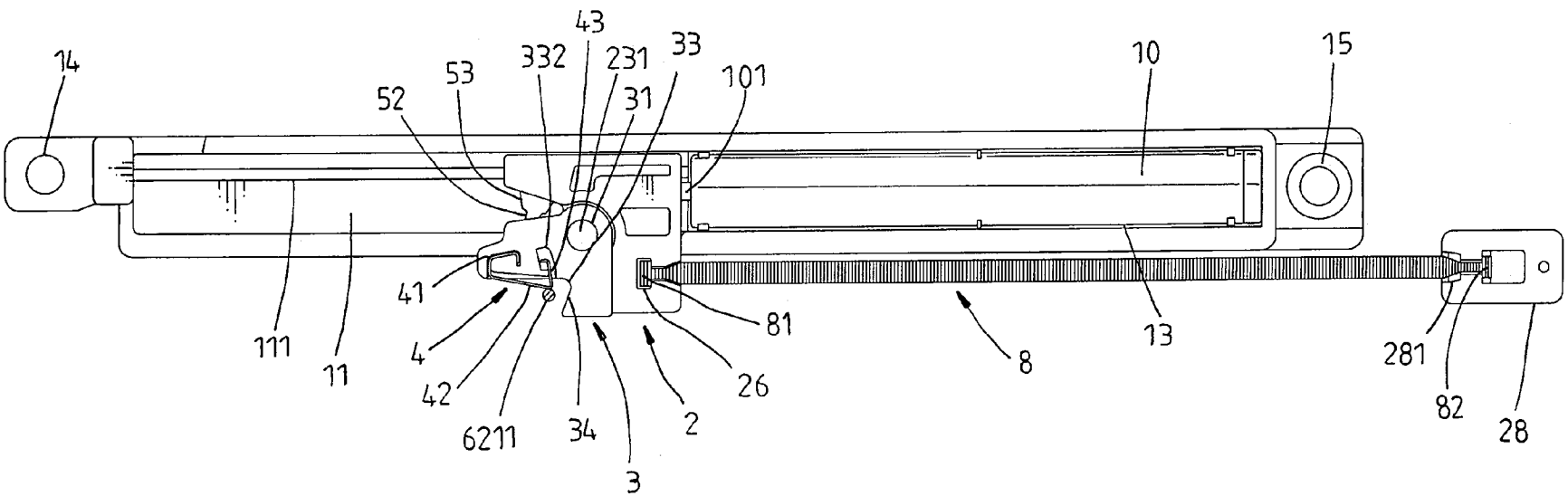
FIG. 12 corresponds to FIG. 11, showing the actuating block stopped against the steel spring strip.
Figure 13:
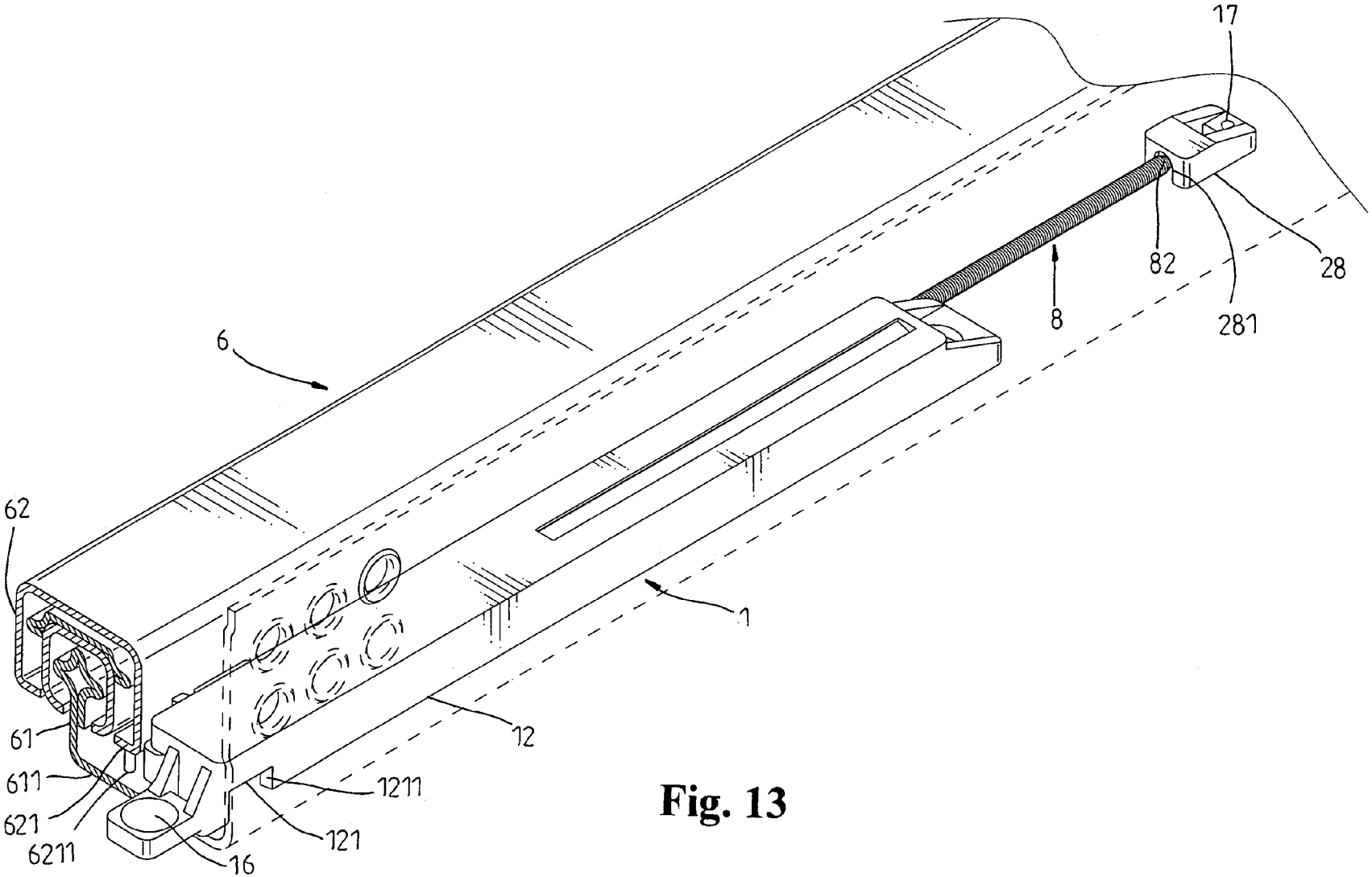
FIG. 13 is a perspective view of the present invention, showing the sliding rail assembly auto locking structure installed in a sliding rail assembly.
Figure 14:
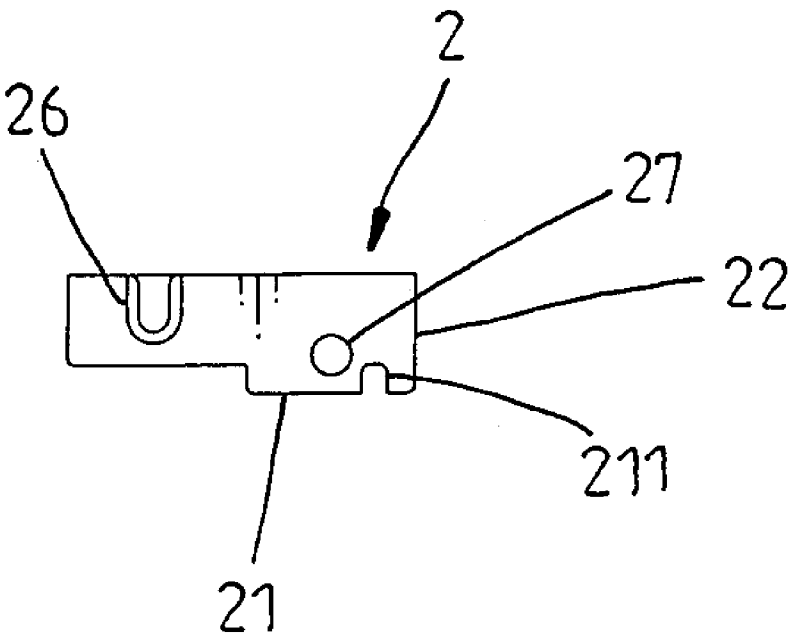
FIG. 14 is a rear plain view of the slide of the sliding rail assembly auto locking structure installed in a sliding rail assembly.

Referring to FIGS. 3~14, a sliding rail assembly auto locking structure is shown used in a sliding rail assembly 6 for drawer (see FIG. 13). The sliding rail assembly 6 has an inner sliding rail 61 affixed to the deck, and an outer sliding rail 62 affixed to a drawer. The sliding rail assembly auto locking structure comprises a holder base 1, a slide 2, a hook 3, a steel spring strip 4, a locking block 5, a actuating block 6211, and a spring member 8.

The holder base 1 has a front mounting through hole 14 and a rear mounting through hole 15 affixed to the bottom wall 611 of the inner sliding rail 61 of the sliding rail assembly 6 with screws 16 and 17 (see FIG. 13), an inside sliding wall 11 on which the slide 2 is reciprocated (see FIG. 5), a guide wall 12 extending along one lateral side of the inside sliding wall 11 for guiding movement of the slide 2 on the inside sliding wall 11, a side notch 121 cut through one end of the guide wall 12, and a stop edge 1211 disposed at one side of the side notch 121.

The slide 2 has a top wall 21 and a side wall 22 adapted to guide reciprocating motion of the slide 2 in the holder base 1, a recessed wall portion 23 (see FIG. 5), a pivot pin 231 disposed in the recessed portion 23 for supporting the hook 3, a side hole 25 transversely disposed near the front side, an outer wall 24, and a locating groove 26 disposed at the rear side.

The spring member 8 has one end 81 fastened to the locating groove 26 of the slide 2 and the other end 82 fastened to a locating groove 281 at a locating block 28 at the bottom wall 611 of the inner sliding rail 61.

The hook 3 is a substantially angled block member having a middle pivot hole 31 coupled to the pivot pin 231 of the slide 2, an inner notch 32, a pivot pin 321 disposed in the inner notch 32 for supporting the locking block 5, an outer opening 33, a locating groove 331 facing the outer opening 33 (see FIG. 7), a notch 332 disposed at one side of the locating groove 331, a retaining block 333 disposed adjacent to the notch 332, and a bearing wall 34 at a rear side of the outer opening 33.

The steel spring strip 4 has a curved front end portion 41, a curved rear end portion 44, an oblique middle portion 42, and a top bearing portion 43 connected between one end of the oblique middle portion 42 and the curved rear end portion 44. The curved front end portion 41 is fastened to the locating groove 331 of the hook 3. The oblique middle portion 42 obliquely outwardly extending from the curved front end portion 41 to the top bearing portion 43. After insertion of the steel spring strip 4 in the locating groove 331 of the hook 3, the top bearing portion 43 is kept spaced from the bearing wall 34 of the hook. 3 at a distance, and the curved rear end portion 44 is secured to the retaining block 333 at the back side of the notch 332 of the hook 3 (see FIG. 9).

The locking block 5 has a coupling portion 51, a pivot hole 511 cut through the coupling portion. 51, a locking body 53, and a neck 52 connected between the coupling portion 51 and the locking body 53. The pivot hole 511 is coupled to the pivot pin 321 of the hook 3, the locking body 53 is inserted into the side hole 25 of the slide 2, and the inner side 531 of the locking body 53 is kept adjacent to the guide wall 12 of the holder base 1.

The actuating block 6211 is fixedly provided at one lateral sidewall 621 of the outer sliding rail 62 of the sliding rail assembly 6 (see FIGS. 9~11 and 13).

When the outer sliding rail 62 is moved outwards with the drawer, the actuating block 6211 is stopped against the top bearing portion 43 of the steel spring strip 4 (see FIG. 11), causing the hook 8 to carry the slide 2 forwards (outwards toward the outside of the desk). When the side hole 25 is aimed at the side notch 121: of the guide wall 12 of the holder base 1, the actuating block 6211 forces the hook 3 to bias and to touch the outer wall 24 of the slide 2, and at the same time the locking body 53 of the locking block 5 is inserted into the side notch 121 of the holder base 1 and stopped at the stop edge 1211, and therefore, the hook 3 is turned inwards to move the top bearing portion 43 of the steel spring strip 4 away from the actuating block 6211 for allowing the drawer to be continuously pulled outwards to the outside of the desk. On the contrary, when the outer sliding rail 62 is moving backwards with the drawer, the actuating block 6211 is forced against the outer side of the bearing wall 34 of the hook 3 to bias the hook 3 and to further force the locking body 53 of the locking member 5 away from the stop edge 1211 of the holder base 1 into the side hole 25 of the slide 2 (see FIG. 10), for enabling the spring member 8 to pull the slide 2 backwards and the top bearing portion 43 of the steel spring strip 4 to be forced against the actuating block 6211 to push the outer sliding rail 62 backwards (see FIG. 11), achieving the auto locking effect.

Further, the locating groove 331 of the hook 3 is detoured. The front end portion 41 of the steel spring strip 4 is detoured and tightly fitted into the detoured locating groove 331 of the hook 3.

Further, if the drawer is vibrated accidentally by an external force or by an earthquake to carry the outer sliding rail 62 toward the outside, the hook 3 does not bias. At this time, the user can push the drawer backwards to force the actuating block 6211 against the oblique middle portion 42 of the steel spring strip 4, causing backward displacement of the oblique middle portion 42, top bearing portion 43 and curved rear end portion 44 of the steel spring strip 4 relative to the curved front end portion 41 (see FIG. 12) so that the actuating block 6211 is further moved over the oblique middle portion 42 of the steel spring strip 4 to the position between the top bearing portion 43 of the steel strip 4 and the bearing wall 34 of the hook 3, and therefore the outer sliding rail 62 and the drawer are returned to the close position.

Further, the holder base 1 has a rear accommodation groove 13 that accommodates a hydraulic cylinder 10. The outer front end 1011 of the reciprocating rod 101 of the hydraulic cylinder 10 is fastened to a locating groove 27 of the slide 2 (see FIG. 14). When the spring member 8 pushes the slide 2 backwards, the reciprocating rod 101 is moved backwards to the inside of the hydraulic cylinder 10 to buffer the return stroke of the slide 2, thereby eliminating noise.

Further, a guide rail 111 is fixedly provided at the inside sliding wall 11 of the holder base 1. The slide 2 has a sliding groove 211 formed on the top wall 21 and coupled to the guide rail 111 to guide smooth movement of the guide rail 111.

As indicated above, the sliding rail assembly auto locking structure has the following benefits:

1. When the outer sliding rail 62 is moved outwards with the drawer, the actuating block 6211 is stopped against the top bearing portion 43 of the steel spring strip 4 to force the hook 3 against the outer wall 24 of the slide 2, and at the same time the locking body 53 of the locking block 5 is inserted into the side notch 121 of the holder base 1 and stopped at the stop edge 1211 to prevent disconnection of the locking block 5 from the stop edge 1211 upon a vibration of the drawer due to an accidental condition. When the outer sliding rail 62 is moved backwards with the drawer, the actuating block 6211 is stopped against the bearing wall 34 of the hook 3 to bias the hook 3 and to further move the locking block 5 away from the stop edge 1211 of the holder base 1 for allowing the steel spring strip 4 to be forced against the actuating block 6211 of the outer sliding rail 62 to push the outer sliding rail 62 and the drawer backwards to the close position, thereby achieving the auto locking effect.

2. The slide 2, the hook 3, the spring member 8 and the locking block 5 are mounted in the holder base 1. The whole assembly has a small size that does not require much installation space. Further, the holder base 1 does not need a cover to keep the inside parts from sight, thereby saving much installation labor and time.

3. When the drawer and the outer sliding rail 62 are forced accidentally by an external force, the hook 3 does not bias outwards, and the user can directly push the drawer backwards to force the actuating block 6211 over the oblique middle portion 421 of the steel spring strip 4 to the position between the top bearing portion 43 of the steel strip 4 and the bearing wall 34 of the hook 3, and therefore the outer sliding rail 62 and the drawer are returned to the close position.

4. The spring member 8 is provided outside the holder base 1. When the spring member 8 is stretched or compressed, the spring member 8 does not rub against the outside wall of the holder base 1. Therefore, the spring member 8 is durable in use, and replacement of the spring member 8 can easily be performed.

5. The hook 3 is pivoted to the slide 2, and the slide 2 is connected to the spring member 8. This arrangement assures smooth reciprocation of the slide 2 in the holder base 1. Further, the hydraulic cylinder 10 buffers the return stroke of the slide 2, eliminating noise.

What is claimed is:

1. A sliding rail assembly auto locking structure used in a sliding rail assembly, said sliding rail assembly comprising an outer sliding rail fixedly mounted on the inside wall of a desk, an inner sliding rail axially movably mounted in said outer sliding rail and affixed to one side panel of a, drawer receivable in said desk, the sliding rail assembly auto locking structure comprising:

a holder base affixed to said inner sliding rail of said sliding rail assembly, said holder base having an inside sliding wall, a guide wall extending along one lateral side of said inside sliding wall, a side notch cut through one end of said guide wall, and a stop edge disposed at one side of said side notch;

a slide adapted to reciprocate on said inside sliding wall along said guide wall of said holder base, said slide having a top wall and a side wall adapted to guide reciprocating motion of said slide in said holder base, a recessed wall portion, a pivot pin disposed in said recessed portion, a side hole transversely disposed near a front side, an outer wall, and a locating groove disposed at a rear side thereof;

a coil spring member, said coil spring member having a first end connected between the locating groove of said slide and a second end fastened to said inner sliding rail;

a hook, said hook having a middle pivot hole coupled to the pivot pin of said slide, an inner notch, a pivot pin disposed in said inner notch, an outer opening, a locating groove facing said outer opening, a positioning notch disposed at one side of the locating groove of said hook, a retaining block disposed adjacent to said positioning notch, and a bearing wall at a rear side of said outer opening;

a steel spring strip, said steel spring strip having a curved front end portion fastened to the locating groove of said hook, a curved rear end portion, an oblique middle portion, and a top bearing portion connected between one end of said oblique middle portion and said curved rear end portion, said oblique middle portion obliquely outwardly extending from said curved front end portion to said top bearing portion; said top bearing portion being kept spaced from the bearing wall of said hook at a distance after insertion of said steel spring strip in the locating groove of said hook;

a locking block, said locking block having a coupling portion, a pivot hole cut through said coupling portion and coupled to the pivot pin of said hook, a locking body inserted into the side hole of said slide, and a neck connected between said coupling portion and said locking body; and an actuating block fixedly provided at one lateral sidewall of said outer sliding rail of said sliding rail assembly for acting against said steel spring strip.

2. The sliding rail assembly auto locking structure as claimed in claim 1, wherein the locating groove of said hook is detoured; the front end portion of said steel spring strip is detoured and tightly fitted into the detoured locating groove of said hook.

3. The sliding rail assembly auto locking structure as claimed in claim 1, further comprising a hydraulic cylinder fixedly mounted inside said holder base, said hydraulic cylinder having reciprocating rod connected to said slide for buffering return stroke of said slide.

4. The sliding rail assembly auto locking structure as claimed in claim 1, wherein said holder base has a guide rail fixedly provided at the inside sliding wall of said holder base; said slide has a sliding groove coupled to said guide rail to guide movement of said slide relative to said holder base.

* * * * *